US007859476B2

(12) United States Patent
Delestre et al.

(10) Patent No.: US 7,859,476 B2
(45) Date of Patent: Dec. 28, 2010

(54) PHASE-SHIFTING CELL HAVING AN ANALOGUE PHASE SHIFTER FOR A REFLECTARRAY ANTENNA

(75) Inventors: Xavier Delestre, Paris (FR); Thierry Dousset, Saint-Gratien (FR); Claude Chekroun, Gif sur Yvette (FR)

(73) Assignee: Thales (FR)

( * ) Notice: Subject to any disclaimer, the term of this patent is extended or adjusted under 35 U.S.C. 154(b) by 703 days.

(21) Appl. No.: 11/871,980

(22) Filed: Oct. 13, 2007

(65) Prior Publication Data

US 2008/0122718 A1 May 29, 2008

(30) Foreign Application Priority Data

Oct. 13, 2006 (FR) ..... 06 09002

(51) Int. Cl.
*H01Q 13/00* (2006.01)
*H01Q 19/06* (2006.01)
*H01Q 15/02* (2006.01)

(52) U.S. Cl. ..... 343/778; 343/754; 343/909

(58) Field of Classification Search ..... 343/700 MS, 343/778, 753–755, 772, 909, 786, 756
See application file for complete search history.

(56) References Cited

U.S. PATENT DOCUMENTS 6,191,748 B1 * 2/2001 Chekroun et al. ..... 343/754
6,429,822 B1 * 8/2002 Naudin et al. ..... 343/754
6,670,928 B1 * 12/2003 Chekroun et al. ..... 343/754
6,806,846 B1 10/2004 West
7,042,397 B2 * 5/2006 Charrier et al. ..... 343/700 MS
7,358,915 B2 * 4/2008 Legay et al. ..... 343/768

FOREIGN PATENT DOCUMENTS

| | | |
|---|---|---|
| FR | 2786610 | 6/2000 |
| FR | 2834131 | 6/2003 |
| WO | 0211238 | 2/2002 |

* cited by examiner

*Primary Examiner*—Jacob Y Choi
*Assistant Examiner*—Robert Karacsony
(74) *Attorney, Agent, or Firm*—Lowe Hauptman Ham & Berner, LLP

(57) ABSTRACT

The present invention relates to the production of reflectarray antennas, that is to say antennas consisting of a primary illumination source and a phase-shifting plate consisting of an array of cells each having a coefficient of reflection the phase of which is electronically controlled. According to the invention, each cell consists of a waveguide element closed at one of its ends by a dielectric substrate wafer carrying an electrical circuit formed by three parallel conducting strips. A variable capacitor, produced either in MEMS technology or by means of a ferroelectric element, is implanted by means of bonding wires on the electrical circuit etched on the substrate. The shape and the arrangement of the three parallel conducting strips constituting the electrical circuit and the way in which the variable capacitor is connected to this circuit make it possible to form, in the plane of the substrate, a phase shifter circuit, the phase shift of which may vary almost continuously over a wide range of variation. Advantageously, the phase shifter circuit thus formed occupies a small volume. The invention applies to the production of dual-polarization reflectarray antennas.

19 Claims, 5 Drawing Sheets

PHASE-SHIFTING CELL HAVING AN ANALOGUE PHASE SHIFTER FOR A REFLECTARRAY ANTENNA

RELATED APPLICATIONS

The present application is based on, and claims priority from, France Application Number 06 09002, filed Oct. 13, 2006, the disclosure of which is hereby incorporated by reference herein in its entirety.

FIELD OF THE INVENTION

The present invention relates to the production of reflectarray antennas, that is to say antennas consisting of a primary illumination source and a phase-shifting plate consisting of an array of cells each having a coefficient of reflection the phase of which is electronically controlled. It relates more particularly to a phase-shifting cell structure allowing almost continuous phase shifting to be achieved over a wide range of variation, in a small volume.

CONTEXT OF THE INVENTION

Prior Art

A reflectarray antenna is made, as is known, from a primary source capable of transmitting or receiving a radio signal, for example a microwave source, and from a phase-shifting plate or reflector consisting of elementary cells, the number of which determines in particular the directivity of the beam and the gain of the antenna. The role of the phase-shifting plate therefore consists in forming a given antenna pattern in the desired direction at the moment in question.

Each elementary cell of the phase-shifting plate, also called a phase-shifting cell, consists, in a known manner, of a waveguide, one end of which is closed by a printed circuit comprising, on its face, on the waveguide side, an etched electrical circuit on which electronic components are implanted, whereas the other face is almost entirely metallized and connected to earth for example. The role of the electronic circuit thus produced mainly consists in applying a phase shift to the incident wave, the phase shift varying so as to direct the antenna beam (antenna lobe) in the desired direction.

The phase variation produced by the cell is generally obtained by modifying, by switching, the value of the susceptance in the plane of the front face of the printed circuit. This susceptance is produced by several etched conducting strips, parallel to the long side of the waveguide, forming the equivalent of a capacitive iris, together with switching elements connected to these strips and operating as switches. Depending on whether a switch placed between two adjacent strips is opened or closed, the overall susceptance, and consequently the phase shift applied to the incident wave, can be varied. Thus, it is possible to produce different phase shifts by combining several conducting strips and implanted switches on the circuit.

To produce these switches, it is known to use active semiconductor components such as for example PIN diodes. It is also known to make use of the technical advantage provided most recently by switch circuits produced in MEMS technology, which technology allows small switches to be produced with characteristics, in terms of isolation and losses, which are better than those of PIN diodes and which also allow reactive elements to be switched in order to form different phase shifter circuits.

However, the phase-shifting devices using such switching elements have several drawbacks. Owing to the size of these circuits and the limited space defined by the cross section of the waveguide, said cross section itself being dictated by the grid spacing of the cell array that it is desired to produce, the number of phase shifter circuits based on PIN diodes or on MEMS switches that it is possible to implant is necessarily limited, so that the phase shift that can be obtained is a phase shift varying only in discrete amounts over a restricted number of states. The limited number of possible phase states that a cell can thus adopt is reflected in imprecision in the possible pattern of the antenna formed, which imprecision is manifested, in a known manner, by quantization losses that limit the overall efficiency of the antenna.

Thus, to form the desired pattern, the phase shift that each cell must apply to the fraction of the signal that it receives is determined and, in each cell, the switch or switches for producing, for the cell in question, the phase shift closest to the required theoretical phase shift are actuated. The systematic error that corrupts the phase shift produced by each cell is then reflected by a drop in efficiency as a result of the difference between the desired pointing direction, for which the maximum antenna gain is desired, and the direction actually pointed. This reduction in efficiency is also due to the increase in side lobes caused by the quantization of the phase shifters.

PRESENTATION OF THE INVENTION

The object of the invention is to solve this efficiency problem that affects current reflectarray antennas, this problem being due mainly to the systematic error produced in the direction pointed by the antenna, which error itself is due to insufficiently fine quantization of the possible values that the phase shift produced by each cell can take.

For this purpose, the subject of the invention is a phase-shifting cell for producing the phase-shifting element of a reflectarray antenna, principally comprising:

- a waveguide closed at one of its ends by a matching element and at its other end by a microwave substrate wafer;
- an electrical circuit consisting of conducting tracks printed on the microwave substrate in the region bounded by the walls of the waveguide; and
- an integrated capacitor implanted on the circuit, the capacitance of which varies continuously according to a control voltage applied to its terminals via the electrical circuit.

According to the invention, the electrical circuit comprises, in the region bounded by the walls of the waveguide, first and second parallel external conducting strips, defining a central region of the substrate, and a third, intermediate conducting strip located in the central region and parallel to the external conducting strips.

Also according to the invention, the integrated capacitor is implanted on the substrate, in the central part, of the central region of the substrate where the static capacitor is produced, one of its terminals being connected to the control voltage via the first external conducting strip, the other terminal being connected to earth via the third, intermediate conducting strip, the connection of the terminals of the capacitor to the conducting strips being performed by connection elements the lengths of which are matched to the working frequency in question.

Also according to the invention, the second external conducting strip includes at least one transverse extension, within the central region, directed towards the intermediate conducting strip, the shape and the dimensions of said extension being determined in order to obtain, for the cell, an overall static capacitor of given capacitance at the working frequency in question.

The cell according to the invention, thus formed, advantageously allows a continuously variable phase shift to be applied to the incident wave. The phase shift induced is furthermore advantageously variable within a range the extent of which is close to 360°.

According to a first embodiment, the integrated capacitor is produced in the form of a component in MEMS technology, the capacitor being produced on a semiconductor substrate having a layer of insulating material, for example glass.

According to another embodiment, the integrated capacitor is produced by means of two electrodes placed on a substrate and separated by an intermediate element consisting of a ferroelectric material.

DESCRIPTION OF THE FIGURES

The features and advantageous of the invention will be better appreciated thanks to the following description, which explains the invention through one particular embodiment taken as a non-limiting example, and supported by the appended figures which show.

DETAILED DESCRIPTION

The device according to the invention will firstly be presented through one particular embodiment given by way of non-limiting example and illustrated by FIGS. 1 to 4.

Figure 1:
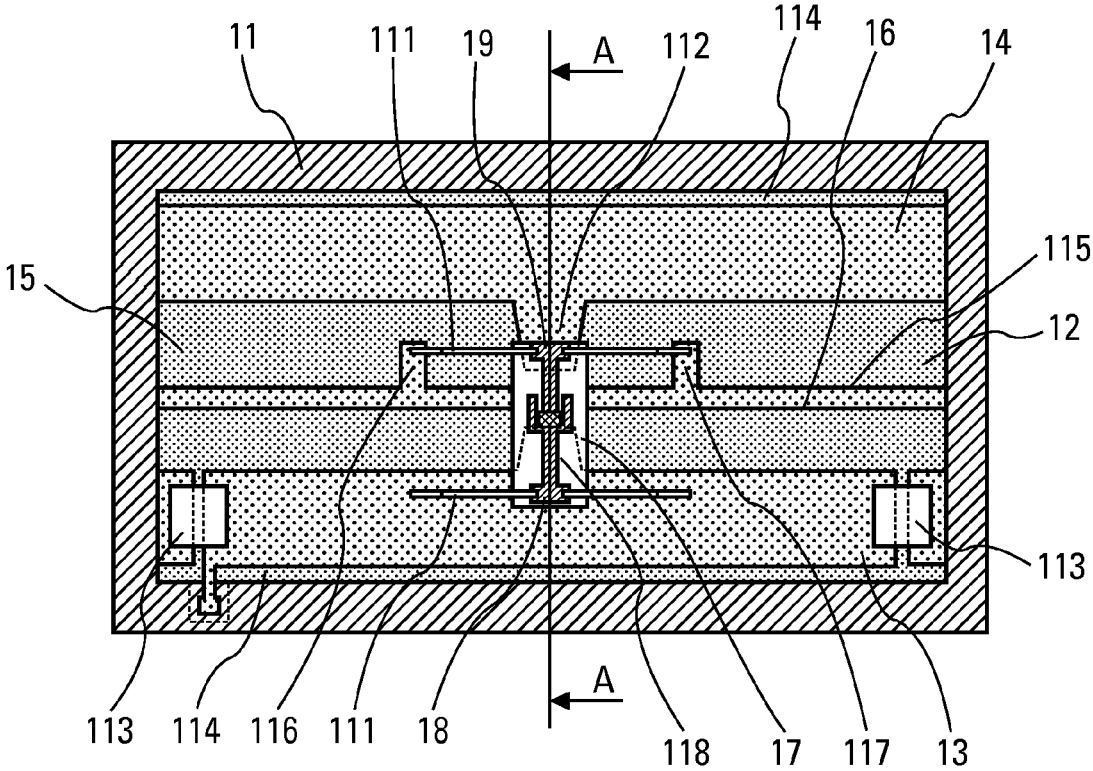
FIG. 1, a schematic representation, in plan view seen from above, of the device according to the invention.
Figure 2:
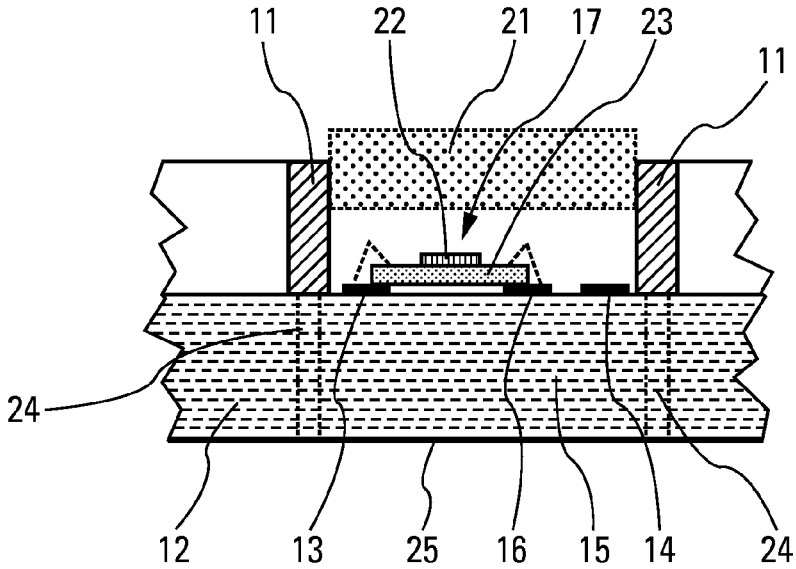
FIG. 2, a schematic representation, in cross section, of the same device.

FIG. 1 shows a top view of the phase-shifting cell according to the invention. As may be seen in the figure, the cell comprises a waveguide 11, seen here in cross section, the end of which is closed by a microwave substrate wafer 12 of high dielectric constant ($\in_r$=4.5 for example). The other end visible in the cross-sectional representation in FIG. 2 is closed by a matching plug 21, the dielectric constant of which allows the wave to be propagated through the waveguide to the substrate 12. Since the matching is therefore achieved by the plug 21 and the substrate 12, it is possible to produce a phase-shifting cell operating at a given frequency while still using a waveguide the dimensions of which make the operating frequency well below their cut-off frequency, a dimensional constraint generally imposed by the grid spacing of the array that it is desired to form, for example a dual-polarization array.

An electrical circuit is etched on that face of the substrate 12 in contact with the walls of the waveguide 11 and in the region bounded by these walls. The etching is carried out by any appropriate printed-circuit process, not developed here. The electrical circuit principally comprises three conducting strips, namely two external conducting strips 13 and 14, defining a central region 15, and an intermediate conducting strip 16 placed in the central region. The three conducting strips are mutually parallel and parallel to the straight line representing the intersection between the plane of the substrate 12 and the plane in which the long side of the waveguide 11 lies. As regards the opposite face of the substrate, this is metallized and constitutes a reflector plane.

According to the invention, the phase-shifting cell also includes an electronic component 17 forming a variable capacitor, the capacitance of which continuously varies through the action of a control voltage. This component is implanted on the substrate 12, preferably in the centre of the central region 15. One of its terminals 18 is connected to the first external conducting strip 13, while the other terminal 19 is connected to the intermediate conducting strip 16. According to the invention, the connections between the terminals 18 and 19 of the capacitor and the conducting strips 13 and 16 are performed by means of appropriate connection elements 111. Furthermore, as illustrated in FIG. 2, the capacitive element 21 integrated into the component 17 is placed on the substrate 22, which substrate is itself placed on the substrate 12 at least partly covering the conducting strips at the point where it is implanted.

According to the invention, the architecture of the electronic circuit formed by the three conducting tracks 13, 14 and 16 and by the variable capacitor 17 is defined so as to produce a practically analogue phase shifter for varying the phase of the received wave over a wide phase-shift range extending substantially from 0° to 360°. To achieve this, the conducting strips making up the electrical circuit etched on the substrate 12 are arranged so as to produce an assembly which, although specifically adapted to the type of component used to form the variable capacitor, has a number of constant morphological characteristics visible in the illustrations of FIGS. 1 and 2.

One of these features consists of the fact that the variable capacitor component 17 is connected only to two in three of the conducting strips, namely one of the external conducting strips—the strip 13—and the intermediate conducting strip 16. The intermediate conducting strip 16 is also narrower than the external conducting strips.

Another of these features consists of the fact that the connection between the terminals of the variable capacitor 17 and the conducting strips 13 and 16 is performed by means of connection elements in the form of straight wires 111 parallel to the conducting strips. These connection elements have dimensions so as to exhibit, at the working frequency, a given inductance, which contributes to the operation of the phase shifter circuit in its entirety.

Another of these features consists of the fact that the variable capacitor 22 produced in the component 17 is placed on a substrate 22 in such a way that the capacitor is not directly in contact with the substrate 12. This results in the formation of a static capacitor $C_{stat1}$, which also contributes to the production of the phase shifter circuit.

Another of these features consists of the fact that the external conducting strip 14, to which the variable capacitor 17 is not connected, makes it possible to form, with the intermediate conducting strip 16, a static capacitor that allows the capacitance of the static capacitor $C_{stat1}$ to be adjusted. For this purpose as illustrated in FIG. 1, the external conducting strip 14 includes an extension 112 approximately perpendicular to its axis and directed towards the interior of the central region towards the intermediate conducting strip 16. The shape and the dimensions of this extension are determined so as to obtain a static capacitor $C_{stat1}$ having the desired capacitance at the working frequency in question. The extension 112 is also produced, as illustrated in FIG. 1, in a region of the substrate close to the region in which the variable capacitor 17 is implanted.

Depending on the technology used to produce the variable capacitor 17, the latter has different dimensions so that it covers to a greater or lesser extent the conducting strips at the point where it is implanted.

As illustrated in FIG. 2, in the electronic arrangement thus produced, the external conducting strip 14, not connected to the variable capacitor 17, and the central conducting strip 16 are connected directly to the earth plane 25 of the circuit by means of vias 24. The external conducting strip 13, connected to the variable capacitor 17, is itself also connected to the control voltage that makes its capacitance vary. This conducting strip 13 is also connected to the earth of the circuit by means of decoupling capacitors 113 in such a way that, from the microwave operating standpoint, all the components of the circuit are connected to earth.

Figure 3:
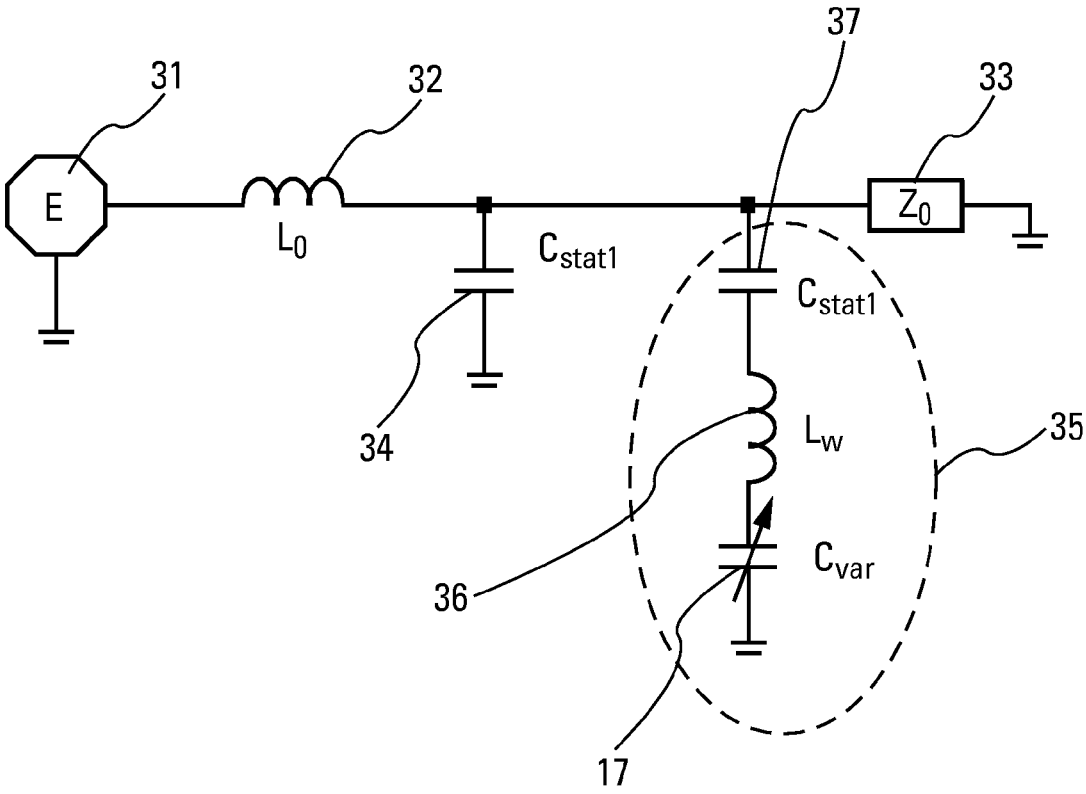
FIG. 3, an equivalent circuit diagram showing the principle of the device according to the invention.

The electronic phase shifter circuit thus formed may be represented from the microwave operating standpoint by the equivalent circuit diagram shown in FIG. 3. The input of the signal into the device is depicted by the input port 31. The equivalent circuit comprises a main line on which there are connected, in series, an inductor $L_0$, 32, which depicts all the electrical connections of the device, and an assembly formed by the parallel connection of an impedance $Z_0$, 33, which depicts the propagation of the wave inside the microwave substrate that carries the electrical circuit, and a capacitor $C_{stat1}$, 34, which represents the capacitance formed between the external edges 114 of the external conducting strips and the walls of the waveguide.

The equivalent circuit also includes an LC cell 35 consisting mainly of the variable capacitor 17 in series with an inductor $L_w$, 36, which represent mainly the elements 111 forming the connection of the variable capacitor to the conducting strips 13 and 16 of the circuit. The cell 35 also includes a capacitor $C_{stat2}$, 37, which represents the capacitance formed by the extension 112 of the conducting strip 14 not connected to the variable capacitor 17, and the external edge 115 of the intermediate conducting strip 16 facing the strip 14. The values of all the components of the equivalent circuit are defined so as to ensure propagation of the wave in the device and also the desired phase-shifting function.

The phase-shifting cell structure according to the invention as described in the foregoing therefore relies on the use of a component having a capacitance that varies according to the applied voltage, associated with an electrical circuit, the components of which are constructed and designed so as to produce a circuit for phase-shifting the incident wave almost continuously over a range varying from approximately 0° to 360° at the working frequency in question.

In a first preferred embodiment, illustrated by FIGS. 1 and 2, the variable capacitor component 17 used is a capacitor produced in MEMS (microelectromechanical system) technology on a semiconductor layer 22 placed for example on a glass support 23. Such a circuit is also called a "capacitive MEMS". It has, among other properties, that of having a capacitance that varies almost continuously according to the level of the DC voltage applied to it. The electrical circuit printed on the substrate is also specifically adapted to this novel component in order to form, with it, the desired phase shifter.

Figure 6:
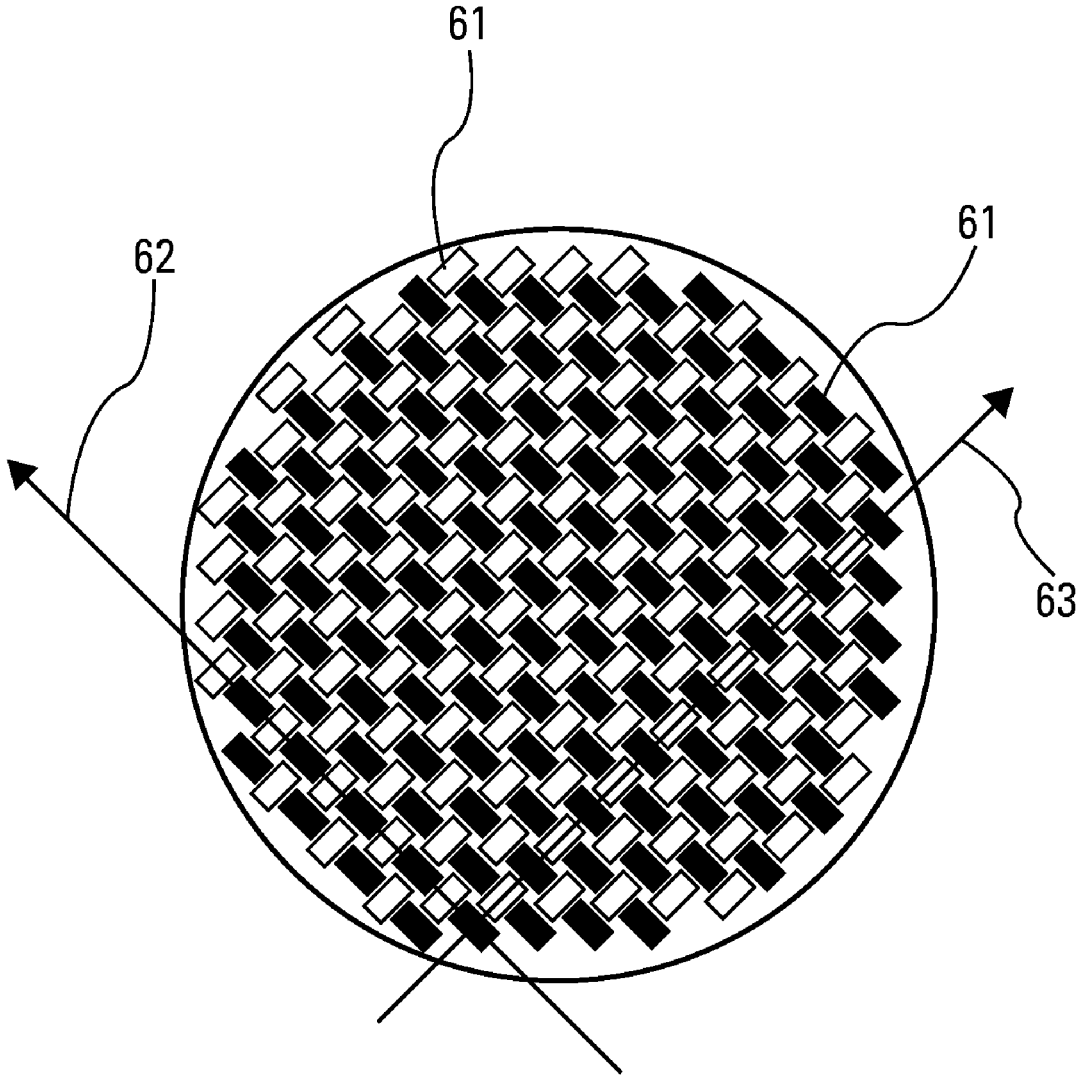
FIG. 6, the illustration of an example of an application of the device according to the invention.

According to the invention, the capacitive MEMS is connected to an external conducting strip 14 and to the intermediate conducting strip 16 by four bonding elements 111. These connection elements are designed, as illustrated in FIG. 6, so as to lie in a plane parallel to the plane of the substrate 12 and to be parallel to the conducting strips 13, 14 and 16 forming the electrical circuit. This type of arrangement advantageously allows the phase shifter circuit thus formed to have the most perfect possible structure symmetry with respect to the vertical axis of the waveguide. The length of the connection elements is also defined so as to have the inductance required for correct operation of the phase shifter in its entirety.

Studies carried out by the Applicant have shown that, advantageously, the variation in phase obtained with a phase-shifting cell according to the invention equipped with a capacitive MEMS is greater than or equal to 300° for a frequency Band possibly reaching up to 20% of the central working frequency, especially in the Ku band (central frequency around 12 GHz), the almost continuous variation in the capacitance then being between 50 and 200 fF (femtofarads). The standard deviation of the phase obtained is also equivalent to that obtained with a phase-shifting cell produced from switches and producing a discrete phase shift coded over 5 bits (32 possible phase shifts) which cell is moreover difficult to produce in the section of a microwave waveguide, especially in the Ku band.

Produced by means of a capacitive MEMS, the cell according to the invention thus only behaves as a single microcomponent for forming the variable capacitor. It therefore has the advantage of being compact and at low cost compared with the existing devices. Moreover, in so far as the capacitive MEMS is voltage-controlled and requires no bias current, such a structure has a low electrical consumption. Thus, it advantageously lends itself well to the fabrication of compact arrays.

Figure 4:
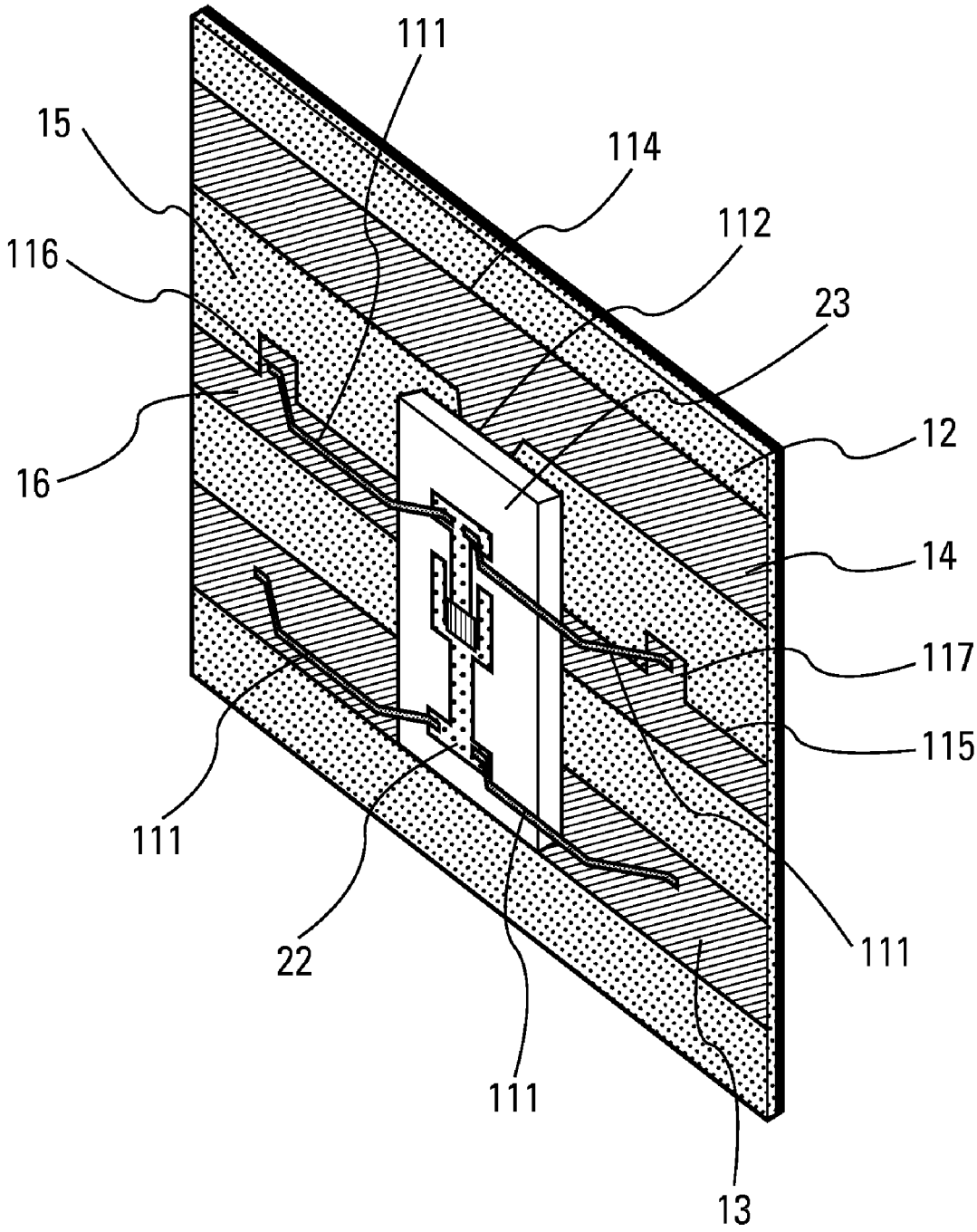
FIG. 4, a schematic representation, in relief, of the same device, allowing the elements of the equivalent circuit diagram of FIG. 3 to be defined.

Depending on the type of capacitive component used and on the size of the latter, its implantation on the substrate and the production of the associated electrical circuit may vary from one embodiment to another, without in any way the cell obtained differing from that described above as regards its essential features. Thus, for example, in order to keep the bonding elements 111 in their horizontal positions parallel to the conducting strips, the intermediate conducting strip may for example include, as illustrated by FIGS. 1 and 4, perpendicular extensions 116 and 117 allowing one of the terminals of the capacitive component 17 to be connected to this conducting strip. Likewise, the external conducting strip 13 connected to one of the terminals of the component 17 may also include one (or more) perpendicular extensions 118 of similar shape to the extension of the other external conducting strip 14, allowing the reactive characteristics of the phase shifter circuit to be adjusted so as to obtain optimum operation of the assembly at the working frequency in question. This extension directed towards the inside of the central region may for example be positioned facing the extension 112 presented by the other external conducting strip.

Figure 5:
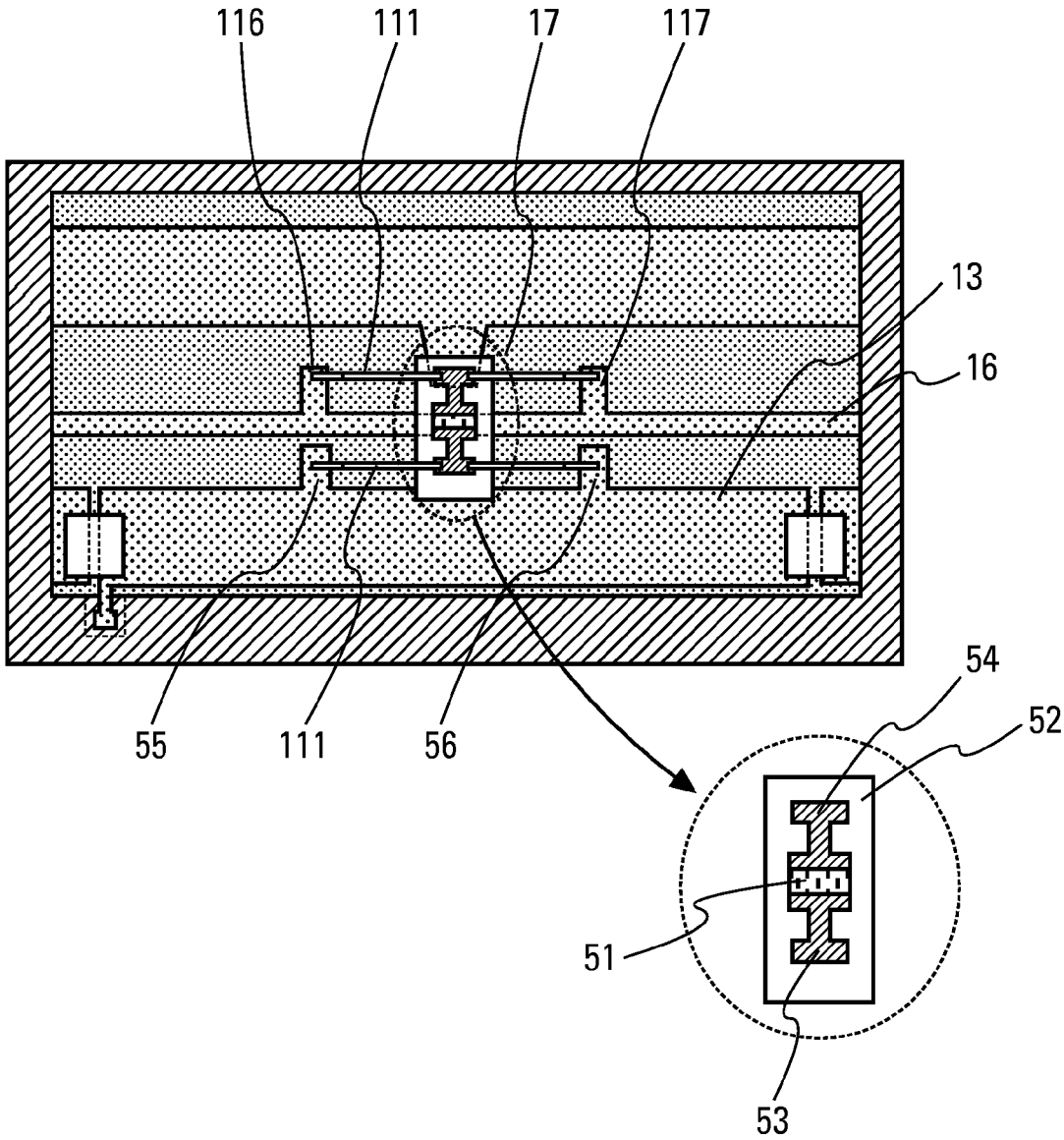
FIG. 5, the illustration of an embodiment in which the variable capacitor is produced by means of a film of ferroelectric material.

In another preferred embodiment, illustrated by FIG. 5, the variable capacitor component 17 used is a capacitor produced by means of a ferroelectric film 51 deposited on a substrate 52, for example an alumina substrate, and bordered by two electrodes 53 and 54. The capacitance of the capacitor thus formed varies according to the applied DC voltage. This type of component makes it possible to produce phase-shifting cells having properties that are advantageously similar to those of phase-shifting cells based on capacitive MEMS described above. Moreover, as may be seen in the figure, this particular embodiment also requires certain matching of the base structure of the cell. For example, it may prove necessary to provide the external conducting strip connected to the capacitive circuit 17 with connection extensions 55 and 56 similar to those with which the intermediate conducting strip 16 is provided.

As mentioned above, the phase-shifting cell structure according to the invention has in particular the following advantages:

- it allows compact phase-shifting cells to be produced at an advantageous production cost in order to fabricate arrays of cells;
- it includes only a single microcomponent to be implanted on the dielectric substrate; and
- the microcomponent employed requires only a simple voltage control and, advantageously, no bias current is needed.

These features considerably simplify the production of a dual-polarization reflectarray antenna in which, on the one hand, the cross section of the waveguides used is necessarily small and, on the other hand, the available space between the waveguides for passage of the controls is very limited. The need to correctly isolate the phase-shifting cells from one another requires in fact a large number of plated-through holes to be produced in the substrate in order to earth the metal grid which forms the waveguides. FIG. 6 shows an illustration of the phase-shifting plate of a dual-polarization antenna produced with phase-shifting cells according to the invention. The cells 61 are arranged therein so as to be almost contiguous, in two groups of rows, the rows of one group being oriented along a direction 62 perpendicular to the direction 63 along which the rows of the other group are oriented, so that, when illuminated by a source emitting two linearly polarized waves—for example one polarized horizontally and the other polarized vertically—the signal reflected by the phase-shifting plate is then a wave composed of two orthogonally polarized waves.

The structure of the phase-shifting cell according to the invention therefore advantageously makes it possible to produce phase-shifting elements having a large number of juxtaposed cells, each cell allowing the phase of the received wave to be varied almost continuously over a range of variation approximately equal to 360°. Apart from its application to an antenna of the single-polarization or dual-polarization reflectarray type, the cell therefore has the possibility of being applied in similar systems, such as antennas of the "transmit array" type, or "folded" reflectarray antennas. It also has, owing to the higher resolution obtained on the phase shifts that it is possible to apply to the received wave, the possibility of being applied in more remote fields, such as the field of dealing with the intrinsic defects presented by an antenna of the reflectarray type, defects such as the presence of reflection lobes or "magicity" lobes. Furthermore, in the case of a single-polarization reflectarray antenna for which it is possible to use waveguides of larger cross section, it should be noted that it is possible to place several capacitive MEMS on the printed circuit or to combine a capacitive MEMS with a switch-type component and to further increase the resolution of the phase shift control.

The invention claimed is:

1. A device for producing a microwave phase-shifting cell of a reflectarray antenna, comprising:

- a waveguide closed at one of its ends by a matching element and at its other end by a microwave substrate wafer;
- an electrical circuit having three parallel conducting strips printed on the microwave substrate wafer, in the region bounded by the walls of the waveguide; and
- a capacitive element connected to the electrical circuit;
- wherein the electrical circuit has first and second parallel external conducting strips, defining a central region of the substrate, and a third, intermediate conducting strip, located in the central region and parallel to the external conducting strips, the conducting strips being at earth potential at the working frequency in question;
- the capacitive element is an integrated capacitor, the capacitance of which varies continuously according to a control voltage applied to its terminals, the integrated capacitor being implanted on a support substrate placed above the central part of the central region and arranged so as to at least partly cover the conducting strips in order to form a static capacitor $C_{stat1}$;
- one of the terminals of the integrated capacitor being connected to the control voltage via the first external conducting strip, and the other terminal being connected to earth via the intermediate conducting strip, the connection for the terminals of the integrated capacitor to the conducting strips being performed by means of connection elements dimensioned and arranged so as to form an inductor of given inductance at the working frequency in question; and
- the second external conducting strip being configured so as to form, with the intermediate conducting strip, a static capacitor $C_{stat}$ allowing the capacitance of the capacitor $C_{stat1}$ to be adjusted at the working frequency in question.

2. The device according to claim 1, wherein the connection elements for connecting the terminals of the integrated capacitor to the conducting strips are wire elements.

3. The device according to claim 2, wherein the intermediate conducting strip includes perpendicular extensions to which the bonding elements connecting it to the integrated capacitor are fastened and the length of which is defined, according to the dimensions of the integrated capacitor used, so that the bonding elements can be placed horizontally and parallel to the conducting strips.

4. The device according to claim 1, wherein the second external conducting strip includes at least one transverse extension, directed towards the inside of the central region towards the intermediate conducting strip, the shape and the dimensions of which extension are determined, a cell having an overall static capacitor of given capacitance at the working frequency in question.

5. The device according to claim 4, wherein the transverse extension is in the form of a trapezium.

6. The device according to claim 4, wherein the first external conducting strip also includes a transverse extension, directed towards the inside of the central region, towards the intermediate conducting strip, the shape and the dimensions of which extension are substantially identical to the shape and the dimensions of the transverse extension of the second external conducting strip not connected to the integrated capacitor.

7. The device according to claim 1, wherein the integrated capacitor is a variable capacitor produced in MEMS technology or a capacitor made of a ferroelectric material.

8. The device according to claim 1, wherein the substrate supporting the integrated capacitive element is made of glass.

9. The device according to claim 1, wherein the microwave substrate wafer is made of a material having a high dielectric constant $\in_r$.

10. The device according to claim 9, wherein the material of the microwave substrate wafer has a dielectric constant $\in_r$ substantially equal to 4.5.

11. The device according to claim 2, wherein the second external conducting strip includes at least one transverse extension, directed towards the inside of the central region towards the intermediate conducting strip, the shape and the dimensions of which extension are determined, a cell having an overall static capacitor of given capacitance at the working frequency in question.

12. The device according to claim 3, wherein the second external conducting strip includes at least one transverse extension, directed towards the inside of the central region towards the intermediate conducting strip, the shape and the dimensions of which extension are determined, a cell having an overall static capacitor of given capacitance at the working frequency in question.

13. The device according to claim 5, wherein the first external conducting strip also includes a transverse extension, directed towards the inside of the central region, towards the intermediate conducting strip, the shape and the dimensions of which extension are substantially identical to the shape and the dimensions of the transverse extension of the second external conducting strip not connected to the integrated capacitor.

14. The device according to claim 2, wherein the integrated capacitor is a variable capacitor produced in MEMS technology or a capacitor made of a ferroelectric material.

15. The device according to claim 3, wherein the integrated capacitor is a variable capacitor produced in MEMS technology or a capacitor made of a ferroelectric material.

16. The device according to claim 2, wherein the substrate supporting the integrated capacitive element is made of glass.

17. The device according to claim 3, wherein the substrate supporting the integrated capacitive element is made of glass.

18. The device according to claim 2, wherein the microwave substrate wafer is made of a material having a high dielectric constant $\in_r$.

19. The device according to claim 3, wherein the microwave substrate wafer is made of a material having a high dielectric constant $\in_r$.

* * * * *